United States Patent [19]

Kreiskorte

[11] 4,173,877

[45] Nov. 13, 1979

[54] RING ROLLING MACHINE

[75] Inventor: Heinz Kreiskorte, Dortmund, Fed. Rep. of Germany

[73] Assignee: Thyssen Industrie AG, Fed. Rep. of Germany

[21] Appl. No.: 887,559

[22] Filed: Mar. 17, 1978

[30] Foreign Application Priority Data

Apr. 7, 1977 [DE] Fed. Rep. of Germany ..... 2715611

[51] Int. Cl.[2] ..... B21H 1/06

[52] U.S. Cl. ..... 72/105; 72/109; 72/107

[58] Field of Search ..... 72/102, 105, 106, 107, 72/109, 110, 111

[56] References Cited

U.S. PATENT DOCUMENTS 238,953 3/1881 Nicols ..... 72/189

FOREIGN PATENT DOCUMENTS 1189514 3/1965 Fed. Rep. of Germany ..... 72/111

1910549 6/1970 Fed. Rep. of Germany ..... 72/108

*Primary Examiner*—Lowell A. Larson

*Attorney, Agent, or Firm*—McGlew and Tuttle

[57] ABSTRACT

A ring rolling machine for rolling a ring blank engaged over a mandrel roll which has an outside diameter smaller than the inside diameter of the mandrel roll comprises a rotatable main roll having an annular curved surface. The main roll is rotated about a fixed axis which is spaced at a fixed distance from the mandrel. Its curved surface is divided into a loading zone having a radius less than the spacing from said main roll access to the ring blank, a rolling zone having a variable radius curved with a continuously increasing value and a rounding zone extending between the rolling zone and the loading zone which is of substantially constant radius.

7 Claims, 9 Drawing Figures

RING ROLLING MACHINE

BACKGROUND OF THE INVENTION

FIELD OF THE INVENTION

The invention relates in general to metal forming and in particular to a new and useful ring rolling machine where the blank to be rolled is held on a mandrel roll whose outside diameter is smaller than the inside diameter of the blank.

Ring rolling machines are known in which the outer contours of the ring are formed as a rule by at least one main roll acting on the blank, this main roll having an invariable profile over its entire circumference. Consequently it is difficult to roll on these machines rings with certain outer contours in one operation so that it is necessary to pass the ring through several rolling stations with differently profiled main rolls.

From DAS No. 21,31, 300 is known a transverse rolling machine where two profile cutting rolls are arranged axis-parallel in a horizontal direction one above the other and which act from the outside on a solid, rod-shaped blank rotating between them. The profile determining the outer contours of the blank is cut into their circumference and a circular segment of the two profile cutting rolls is followed by a rolling zone, acting on the blanks, which is curved with a constantly increasing radius.

SUMMARY OF THE INVENTION

The present invention provides a ring rolling machine with which it is possible to produce rings with outer profiles in one operation and which had to be done heretofor in several operations in two or more rolling stations.

The profile cutting rollers with a constantly increasing roll radius known from the above mentioned German patent for a transverse rolling machine are used in a ring rolling machine where the blank to be rolled is held on a mandrel roll whose outside diameter is smaller than the inside diameter of the blank, and where the outer contours of the ring are formed by a main roll acting on the blank, which has on its circumference proceeding in a rolling direction successively: a loading zone, a rolling zone and a rounding zone. The rolling zone is curved in a spiral arc with a constantly increasing radius.

The ring rolling machine, according to the invention, has the advantage of rolling a ring blank with a single revolution of the main roll to the provided basic wall thickness and of giving the ring a predetermined outer profile which deviates, for example, in many points from the cylinder form. The production of profiled rings on such a rolling machine requires much less time than on conventional ring rolling machines and is therefore more economical. It also was found advisable to provide the rounding zone of the main roll with a constantly increasing radius similar to the rolling zone but with the rate of increase being less than in the rolling zone. This results in an advantageous precompression of the ring material.

While it is necessary in the presently known ring rolling machines for rolling highly profiled outer contours to make several individual rollings, the invention offers the possibility of also producing such rings in practically one operation on a machine. To this end, a profile designed according to the desired ring cross section is cut in known manner into the rolling zone of the main roll, whose cross section has a form varying constantly over the length of the rolling zone. With such a main roll the ring material is deformed gradually increasing to the finished form. The stretched length of the rolling zone of the main roll depends naturally on the diameter of the main roll and on the portions of the loading zone and of the rounding zone on the circumference of the main roll. It follows therefore that the size of rings which can be rolled with a main roll would be limited in circumference of the rolling machine according to the invention in one operation, since the diameter cannot be selected at random beyond a size limited by the size of the rolling machine.

In order to be able to use the ring rolling machine for rolling rings with a large diameter it is therefore provided in a development of the invention to arrange at least two rolling zones axially in series. This can be done, on the one hand, in this way that the rolling zone extends helically about the outside of the main roll. Another possibility is to arrange two or more main rolls or main roll discs with corresponding profiled circumferential surfaces axially in series. Particularly the first-mentioned embodiment offers the possibility of providing the main roll with a rolling zone of any desired length for extremely large rings. For rolling the corresponding ring it is merely necessary that the main roll perform more than only one revolution until the ring to be rolled has turned once about its axis.

Finally it is suggested in a further development of the invention to equip the ring rolling machine in known manner with two or more roll mandrels which are arranged adjustably relative to the main roll. In this way it is possible to roll several rings of the same profile simultaneously on the machine and to considerably increase the output of the ring rolling machine, compared to a machine equipped with only one mandrel roll.

It goes without saying that the mandrel roll can be arranged and designed exchangeably, so that it is also possible to roll on the ring rolling machine rings with a different inner profile.

Accordingly, it is an object of the invention to provide a ring rolling machine for rolling a ring blank engaged over a mandrel or roll which has an outside diameter smaller than the inside diameter of the mandrel roll, which comprises a rotatable main roll having an annular curved surface with means supporting the roll for rotation about an axis which is at a fixed distance from the mandrel and wherein the surface is divided into a loading zone having a radius less than the spacing from the main roll axis to the ring blank, a rolling zone having a variable radius curved with a constantly increasing value including at least a portion of a radius to engage the ring blank during rotation to roll it to the desired shape, and a rounding zone extending between the rolling zone and the loading zone of a substantially constant radius for engaging in finish rounding rolling of the mandrel.

A further object of the invention is to provide a ring rolling machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Figure 3:
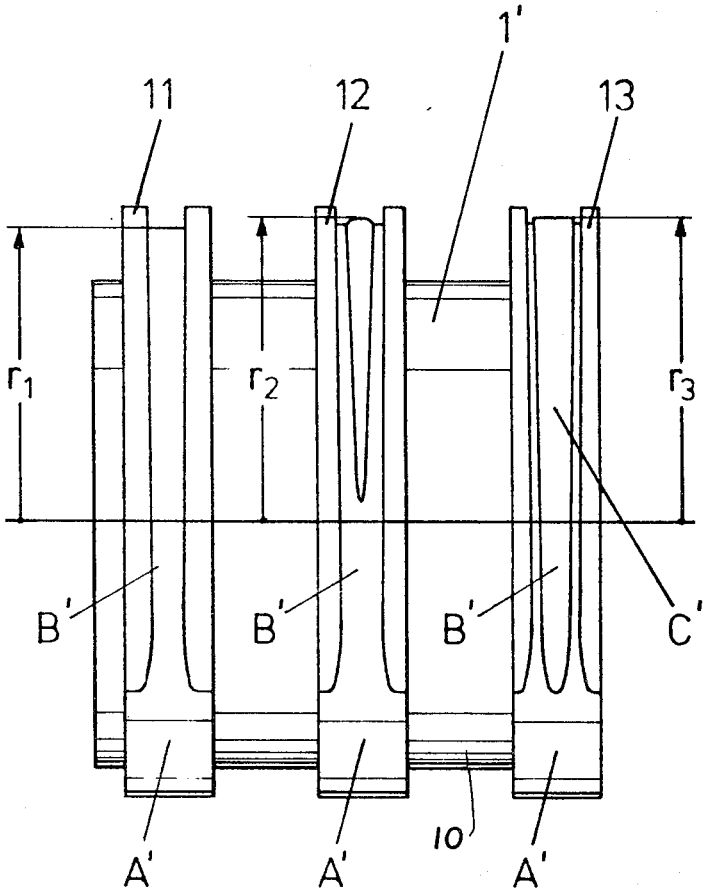
Figure 4:
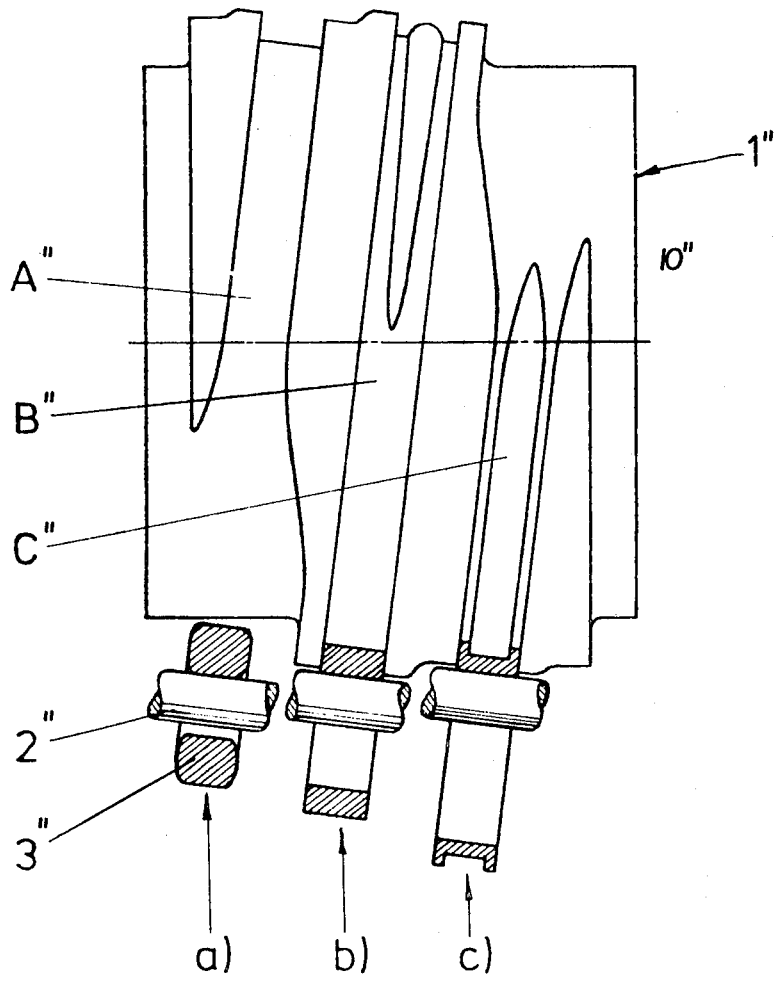

FIG. *2a* to *2f* comprise individual enlarged sectional views showing the various stages of rolling a ring blank with the machine of the invention;

FIG. 3 is a side elevational view of a drum-shaped main roll having three separate roll discs so that the loading zone, rolling zone and rounding zone are arranged axially side by side; and FIG. 4 is a view similar to FIG. 3 of another embodiment of the invention.

GENERAL DESCRIPTION OF THE PREFERRED EMBODIMENTS

Figure 1:
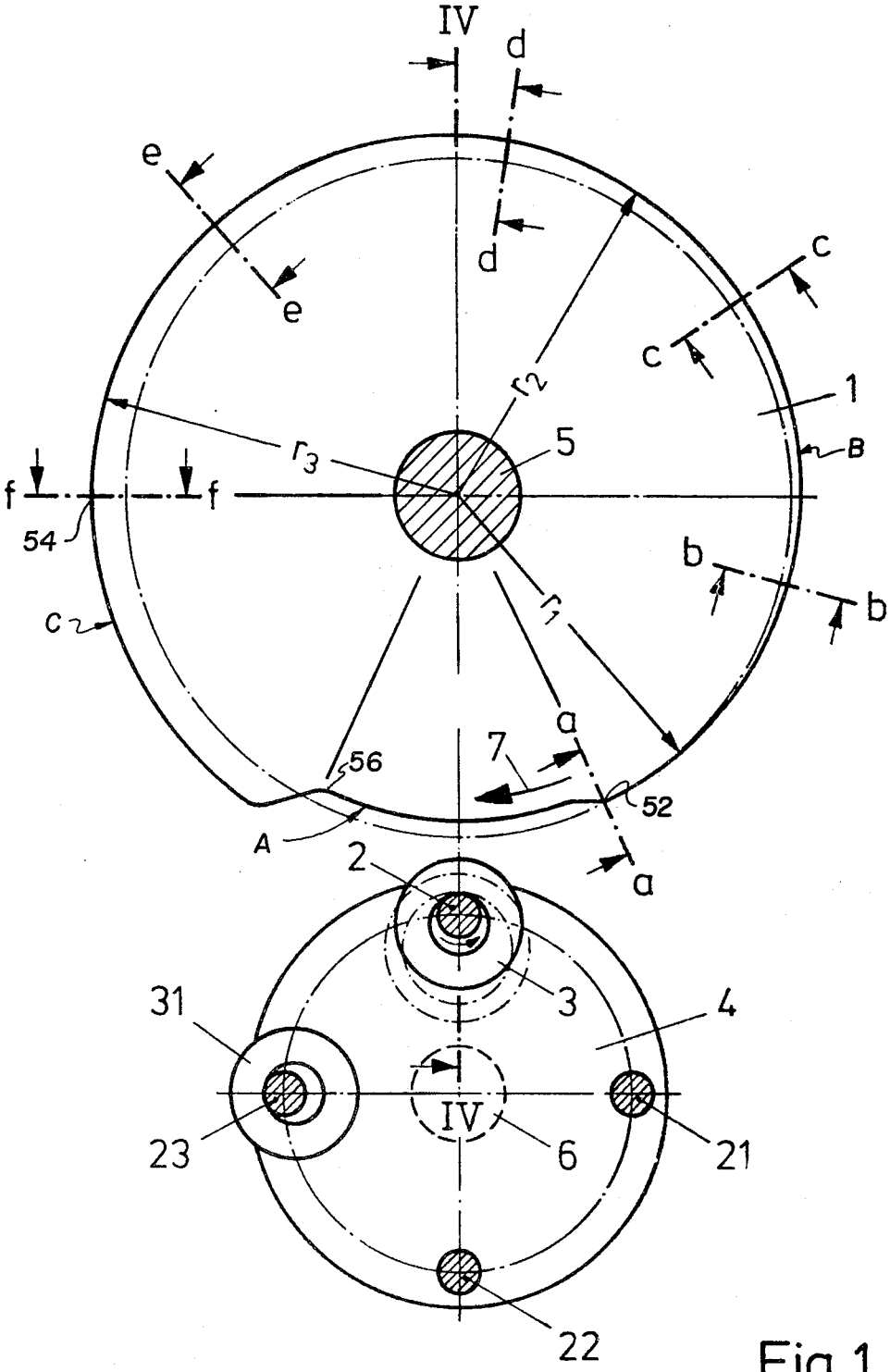
FIG. 1 is a horizontal sectional view of a rolling machine constructed in accordance with the invention.
Figure 2A:
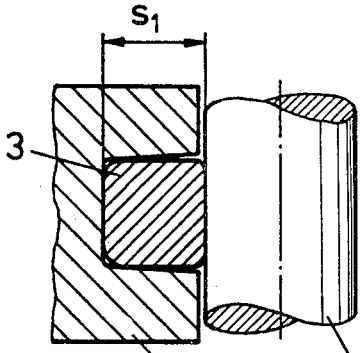
Figure 2B:
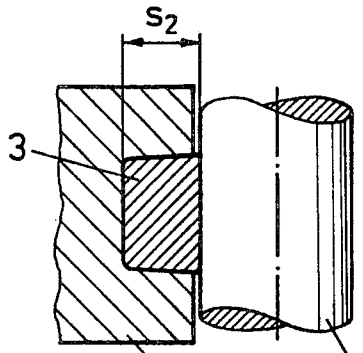
Figure 2C:
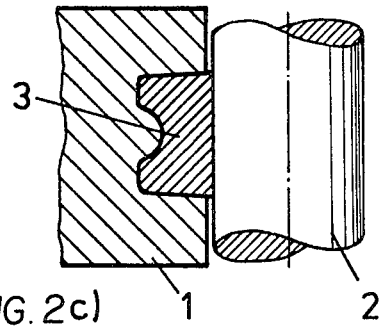
Figure 2D:
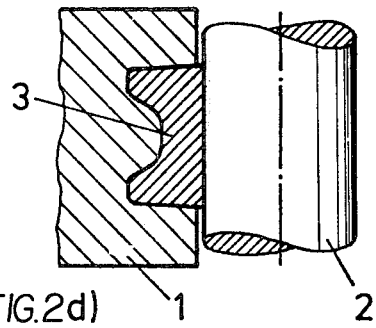
Figure 2E:
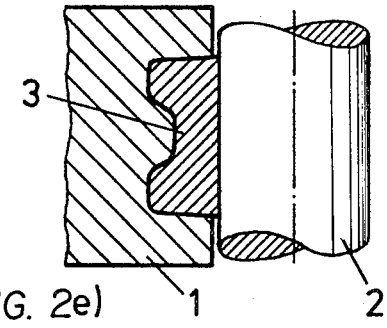
Figure 2F:
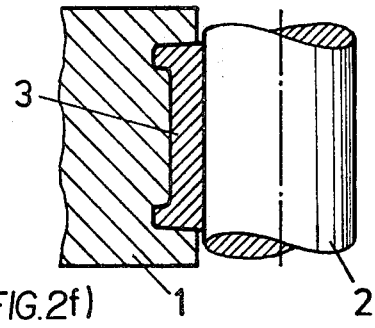

Referring to the drawings in particular, the invention embodied therein as shown in FIGS. 1 and *2a* to *2f* comprises a main roll 1 which is mounted for rotation on a shaft 5 about a fixed axis from a mandrel rotary table 4 which has a plurality of mandrel rolls 2, 21, 22, and 23.

The main roll 1 rotating primarily at a constant speed has a circumference 50 divided into a loading zone A, a rolling zone B, and a rounding zone C. Rolling zone B is curved in a spiral arc with a constantly increasing radius from a point 52 to a point 54. While loading zone A which extends from a point 56 to point 52 of main roll 1 passes by mandrel roll 2, a ring blank 3 is brought in known manner into rolling position, in the selected example by means of a rotary table 4 on which additional mandrel rolls 21, 22 and 23 are arranged and where an additional ring blank 31 is already provided. Since the distance of the axis of rotation 5 of main roll 1 from the axis of rotation 6 of rotary table 4, and thus of mandrel roll 2, it not changed during the rolling, ring blank 3 is given the desired outer profile if main roll 1 is turned in the direction of arrow 7 and the rising profile of rolling zone B of main roll 1 is pressed in or against the material of ring blank 3 which turns with the rotating mandrel roll 2, due to the friction on main roll 1. After passing through rolling zone B, main roll 1 continues to rotate and its rounding zone C which extends from point 54 to point 56 calibrates the ring 3 with constant radius to the finished outside dimensions and form.

The rolling zone B forms a profile of ring 3 whose cross section has a form varying constantly over the lengths of the rolling zone, as can be seen from the cutouts of the main roll in area B represented in FIGS. 2 and 3. This profile form makes it possible to vary ring blank 3 both in width and diameter and to profile it. At the start of rolling zone B the profile of main roll 1 (see FIG. *2a*) corresponds substantially to the cross section of ring blank 3. Up to about 1/5th of the rolling zone B, its profile changes corresponding to FIG. *2b*, and the thickness of ring blank 3 is reduced, for example, from S1 to S2. Since ring blank 3 is rolled over the entire width, its diameter is increased in this rolling operation. When main roll 1 continues to rotate, the contours of ring blank 3 are rolled corresponding to the constantly varying profile of the rolling zone of main roll 1 down to the cross section represented in FIG. *2f*.

According to FIG. 3, drum-shaped main roll 1' includes a cylinder 10, and three main axially spaced roll discs 11, 12, and 13. Each disc 11, 12 and 13 has a loading zone A' and rolling zone B', which is followed on main roll disc 13 by a rounding zone C'. Just as in a main roll where the three zones are arranged in one plane, the radius of the rolling zone increases constantly in this embodiment too from radius $r_1$ up to the start of the rounding zone to $r_3$. When the mandrel roll (not shown) is opposite a loading zone A the ring (likewise not shown) is brought into rolling position by axial displacement with or on the mandrel roll in front of one of the three main rolling discs 11, 12, 13.

FIG. 4 shows in a view toward a main roll 1'' with a loading zone A'', rolling zone B'', and rounding zone C'' which extend helically about the outside of a cylinder 10''. The locations a, b, and c show how the diameters and the form of ring blank 3'' vary constantly during the hobbing on main roll 1'' to the provided form. Naturally, the axis of mandrel roll 2 must be inclined corresponding to the pitch of the helix and must be so displaceable that the main roll and the mandrel roll form the desired roll gap.

I claim:

1. A ring rolling machine for rolling a ring blank engaged over a mandrel roll which has an outside diameter smaller than the inside diameter of the ring blank, comprises a rotatable main roll having an annular curved surface, means rotatably supporting said main roll for rotation about an axis at a fixed distance from said mandrel, said surface being divided into a loading zone having a radius less than the spacing from said main roll axis to said ring blank, a rolling zone having a variable radius being curved with a constantly increasing value and including at least a portion of a radius to engage the ring blank during rotation to roll the ring blank to a defined shape, and a rounding zone extending between said rolling zone and said loading zone of a substantially constant radius.

2. A ring rolling machine according to claim 1, wherein said rolling zone has a profile whose cross section has a form varying constantly over the length of the rolling zone.

3. A ring rolling machine according to claim 1, wherein at least the rolling zone extends helically about the outside of said main roll.

4. A ring rolling machine according to claim 1, including an additional main roll, said rolls being arranged axially in series.

5. A ring rolling machine according to claim 1, wherein said mandrel comprises a rotatable table mandrel having a plurality of ring supporting mandrel rolls of smaller diameters than the inside diameters of the rings, said table being rotatable to index each mandrel into opposition and proximity with the main roll.

6. A ring rolling machine according to claim 1, wherein said main roll comprises a single cylinder, a plurality of discs on said cylinder at spaced axial locations, each disc including at least one zone defined thereon.

7. A ring rolling machine according to claim 1, wherein said main roll comprises a roll cylinder having a spiral projection formed thereon, with each of said zones being defined along the length of said spiral projection, the mandrel including an axis which may be positioned normal to the spiral projection surface.

* * * * *